US011261686B2

(12) United States Patent
Baca et al.

(10) Patent No.: US 11,261,686 B2
(45) Date of Patent: Mar. 1, 2022

(54) TENSION LATCH TUBING HANGER APPARATUS

(71) Applicant: FMC Technologies, Inc., Houston, TX (US)

(72) Inventors: Brian J. Baca, Houston, TX (US); Roman Chirko, Houston, TX (US); Cassandra E. Weimer, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 16/632,600

(22) PCT Filed: Jun. 27, 2018

(86) PCT No.: PCT/US2018/039685

§ 371 (c)(1),
(2) Date: Jan. 21, 2020

(87) PCT Pub. No.: WO2019/018108

PCT Pub. Date: Jan. 24, 2019

(65) Prior Publication Data

US 2020/0240230 A1 Jul. 30, 2020

Related U.S. Application Data

(60) Provisional application No. 62/535,608, filed on Jul. 21, 2017.

(51) Int. Cl.
*E21B 33/04* (2006.01)

(52) U.S. Cl.
CPC ..... *E21B 33/04* (2013.01)

(58) Field of Classification Search
CPC ..... E21B 33/04
See application file for complete search history.

(56) References Cited

U.S. PATENT DOCUMENTS 3,933,202 A * 1/1976 Ahistone ..... E21B 33/043 166/182
5,653,289 A 8/1997 Hosie et al.
(Continued)

OTHER PUBLICATIONS

International Search Report issued in corresponding International Application No. PCT/US2018/039685 dated Oct. 9, 2018 (4 pages).
(Continued)

*Primary Examiner* — Dany E Akakpo
(74) *Attorney, Agent, or Firm* — Osha Bergman Watanabe & Burton LLP

(57) ABSTRACT

A tubing hanger assembly including an outer hanger body (8) lands on a load shoulder (10) of a tubing head. Additionally, an inner hanger body (9) having at least one inner hanger groove (19) moves vertically up and down with respect to the outer hanger body and engages at least one downhole device. A first latch ring (11) expands into a groove (12) of the tubing head to lock the outer hanger body in position and a sleeve (14) with a plurality of grooves (20) is disposed between the outer hanger body and the inner hanger body of the tubing hanger assembly. Furthermore, a second latch ring (15), disposed between the sleeve and the inner hanger body, expands into or collapse out of the at least one inner hanger groove (19) and the plurality of grooves (20) on the sleeve (14), and the second latch ring (15) is a tension loading support for the inner hanger body.

20 Claims, 8 Drawing Sheets

(56) References Cited

U.S. PATENT DOCUMENTS

| | | | | |
|---|---|---|---|---|
| 2011/0005774 | A1 | 1/2011 | Sinnott et al. | |
| 2012/0085552 | A1* | 4/2012 | Travis | E21B 43/126 166/382 |

OTHER PUBLICATIONS

Written Opinion issued in corresponding International Application No. PCT/US2018/039685 dated Oct. 9, 2018 (6 pages).

* cited by examiner

TENSION LATCH TUBING HANGER APPARATUS

CROSS-REFERENCE TO RELATED APPLICATIONS

This application claims benefit, under 35 U.S.C. § 119, of U.S. Provisional Application Ser. No. 62/535,608 filed on Jul. 21, 2017 and entitled "Tension Latch Tubing Hanger Apparatus and Methods of use thereof." The disclosure of this U.S. Provisional Application is incorporated herein by reference in its entirety.

FIELD OF THE DISCLOSURE

Embodiments disclosed herein relate to an apparatus and process for a tension tubing hanger for tensioning well tubing.

BACKGROUND

A tension tubing hanger is a component used in the completion of oil and gas production wells. The tension tubing hanger is set in the tree or the wellhead and suspends the production tubing. Sometimes the tension tubing hanger provides porting to allow the communication of hydraulic, electric and other downhole functions, as well as chemical injection. In well operations, it is often necessary to provide means for supporting a tubing string within a tubing head or other wellhead component. Additionally, the tension tubing hanger, which supports the tubing string, may be locked in its position in the tree or wellhead. Furthermore, a landing string and landing tool used for lowering the tubing assembly may be readily and easily disconnected from the tension tubing hanger. Lastly, the tension tubing hanger may be provided with a seal against the tree in its locked position in the tree.

The tension tubing hanger allows a tubing string to be lowered into a production casing below a tubing head in a wellhead and latched downhole. Then tension tubing hanger is tensioned back up prior to final landing and locking to the tubing head. This compensates for elongation due to temperature variations during well completion. It also ensures the tubing string is not exposed to the buckling that can occur with conventional tubing hanger applications. Furthermore, tension tubing hangers generally include an outer body hanger and inner body hanger. As such, tension tubing hangers function by locking the outer hanger body in place and allowing the inner hanger body, with a tubing string, to engage with a lower structure. Once engaged with the lower structure, the inner hanger body may be pulled upwards to apply tension to the tubing string. Then to maintain tension, the inner hanger body may be axially locked with respect to the outer hanger body.

Prior proposed tension tubing hangers and landing systems have included a variety of constructions for supporting a tubing string in a casing and for effecting a seal between the tension tubing hanger and the casing. In such prior systems, locking of the tension tubing hanger in the casing or other well component required either difficult mechanical manipulation of the landing tool or auxiliary hydraulic actuation systems to achieve such locking. Such prior proposed systems were complex, were time-consuming, and in some instances, were likely to create additional problems because during manipulation of the landing tool and string to achieve locking, parts of the landing system might be detached due to rotation of the landing tool and landing string.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, the embodiments disclosed herein relate to a tubing hanger assembly including an outer hanger body may land on a load shoulder of a tubing head; an inner hanger body having at least one inner hanger groove and may move vertically up and down with respect to the outer hanger body and engage at least one wellbore device; a first latch ring may expand in a groove of the tubing head to lock the outer hanger body in position; a sleeve with a plurality of grooves disposed between the outer hanger body and the inner hanger body of the tubing hanger assembly; and a second latch ring disposed between the sleeve and the inner hanger body, the second latch ring is may expand into or collapse out of the at least one inner hanger groove and the plurality of grooves, and second latch ring is a tension loading support for the inner hanger body.

In one aspect, the embodiments disclosed herein relate to a method including landing an outer hanger body of a tubing hanger assembly on a load shoulder of a tubing head; locking the outer hanger body of the tubing hanger assembly in position with a first latch ring expanding into a groove of the tubing head; moving down an inner hanger body of the tubing hanger assembly to engage at least one wellbore device and moving the inner hanger body up; collapsing a second latch ring into at least one inner hanger groove; moving up the inner hanger body to expand the second latch ring into one of a plurality of grooves in a sleeve to provide a tension load support for the inner hanger body and the at least one wellbore device; and expanding the second latch ring in a second of the plurality of grooves by further moving up the inner hanger body, and moving the inner hanger body down and disengaging the at least one wellbore equipment.

In one aspect, the embodiments disclosed herein relate to a system including a wellhead; a tubing head with a load shoulder; a tubing hanger assembly including an outer hanger body configured to land on the load shoulder of the tubing head; an inner hanger body having at least one inner hanger groove and may move vertically up and down with respect to the outer hanger body and engage at least one wellbore device; a first latch ring may expand in a groove of the tubing head to lock the outer hanger body in position; a sleeve with a plurality of grooves disposed between the outer hanger body and the inner hanger body of the tubing hanger assembly; and a second latch ring disposed between the sleeve and the inner hanger body, the second latch ring is may expand into or collapse out of the at least one inner hanger groove and the plurality of grooves, and second latch ring is a tension loading support for the inner hanger body.

Other aspects and advantages will be apparent from the following description and the appended claims.

DETAILED DESCRIPTION

Figure 1:
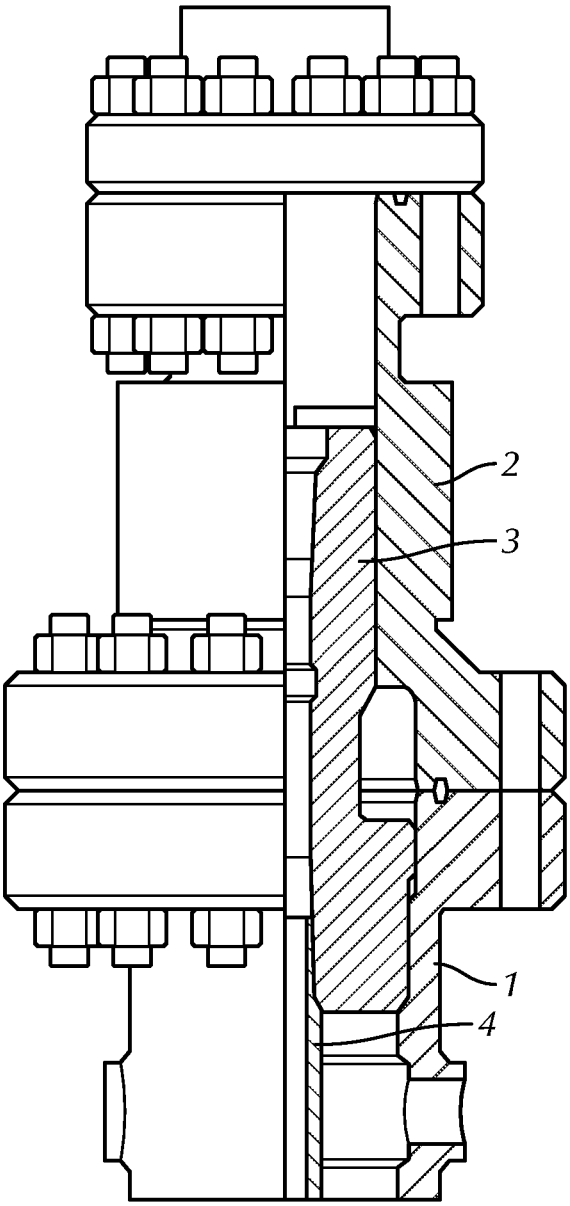
FIG. 1 (Prior Art)
FIG. 1 is a perspective view of a wellhead in accordance with one or more embodiments of the prior art.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

As used herein, the term "coupled" or "coupled to" or "connected" or "connected to" may indicate establishing either a direct or indirect connection, and is not limited to either unless expressly referenced as such. Wherever possible, like or identical reference numerals are used in the figures to identify common or the same elements. The figures are not necessarily to scale and certain features and certain views of the figures may be shown exaggerated in scale for purposes of clarification.

Embodiments disclosed herein generally relate to an apparatus for locking a tension tubing hanger in a tubing head plug retrieval and installation device for wellbore interventions and a method of locking the tension tubing hanger. In some embodiments, a latching device disclosed herein may be used following the method disclosed herein to lock or unlock the tension tubing hanger from the tubing head.

Referring to FIG. 1, FIG. 1 illustrates wellhead 1 in accordance with one or more embodiments of the prior art. Wellheads are well known in the art, and thus, a brief overview is given to help provide a general view the embodiments disclosed herein. The wellhead 1 includes a tubing head 2 disposed on the wellhead 1. Additionally, the tubing head 1 contains a tubing hanger assembly 3 for engaging down hole equipment (not shown). Furthermore, the wellhead and the tubing head 2 may include a port 4 to perform various wellbore and annulus operations. One with ordinary skill in the art would understand that FIG. 1 illustrates one example of a wellhead; however, the wellhead 1 may take any form (i.e., number of components, shape, or size) known in the art without departing from the scope of the present disclosure.

Figure 2:
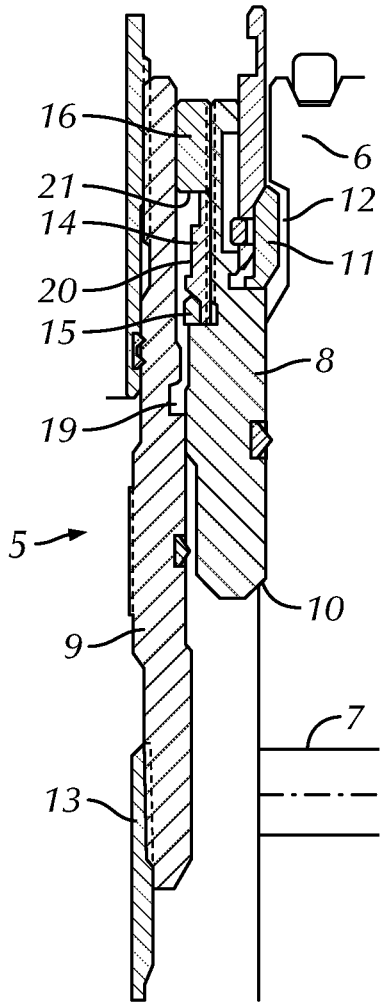
FIG. 2 is a cross-sectional view of a tubing hanger assembly in accordance with one or more embodiments of the present disclosure.

Now referring to FIG. 2, in one or more embodiments, a tubing hanger assembly 5 in accordance with the present disclosure is illustrated. The tubing hanger assembly 5 includes an outer hanger body 8 and an inner hanger body 9. The outer hanger body 8 may be directly connected to a tubing head 6 by landing on a load shoulder 10 of the tubing head 6. In order to lock the outer hanger body 8 on the tubing head 6, a first latch ring 11 expands from the outer hanger body 8 into a groove 12 of the tubing head 6, as will be further explained in FIGS. 6*a* and 6*b*. The groove 12 may be machined, forged, cast, or formed by a manufacturing process known in the art. Furthermore, the first latch ring 11 is attached to the outer hanger body 8. One skilled in the art will appreciate how the first latch ring 11 may be made from steel or another material having sufficient strength, tensile strength, flexural strength and other properties needed to perform the support described herein associated with tension loading. Once the outer hanger body 8 is locked, an upward movement of the outer hanger body 8 may be hindered by the first latch ring 11 and a downward movement of the outer hanger body 8 may be blocked by the shoulder 10 of the tubing head 6. Additionally, the tubing head 6 is shown to have a port 7 to transport fluid in and out of an annulus of a wellhead (not shown).

In some embodiments, the inner hanger body 9 is coupled to at least one wellbore device 13. For example, the wellbore device 13 may be a tubing string, and thus allowing the inner hanger body 9 to engage tools further down in a wellbore (i.e., a packer or other down hole devices). As such, the inner hanger body 9 may move vertically up and down with respect to the outer hanger body 8. Additionally, the outer hanger body 8 may have a threaded nut 16 to limit the maximum upward movement of the inner hanger body 9. The threaded nut 16 has a shoulder stop 21 to engage and stop the inner hanger body 9. Furthermore, a fixed sleeve 14, having a plurality of grooves 20, is disposed in between the inner hanger body 9 and the outer hanger body 8. The plurality of grooves 20 may be machined, forged, cast, or formed by a manufacturing process known in the art. The plurality of grooves 20 may include ledges, inclines, and shoulders on the fixed sleeve 14. The plurality of grooves 20 are used to expand and collapse a second latch ring 15 disposed in between the inner hanger body 9 and the fixed sleeve 14. Furthermore, the inner hanger body 9 may have at least one inner hanger groove 19 to aid in expanding and collapsing the second latch ring 15. The at least one inner hanger groove 19 may be machined, forged, cast, or formed by a manufacturing process known in the art. The at least one inner hanger groove 19 may include ledges, inclines, and shoulders on the inner hanger body 9 to facilitate movement of the second latch ring 15. Additionally, the second latch ring 15 may move vertically to be used as a stop to support the inner hanger body 9 and a tension load from the inner hanger body 9. One skilled in the art will appreciate how the second latch ring 15 may be made from steel or another material having sufficient strength, tensile strength, flexural strength and other properties needed to perform the support described herein associated with tension loading.

Figure 3:
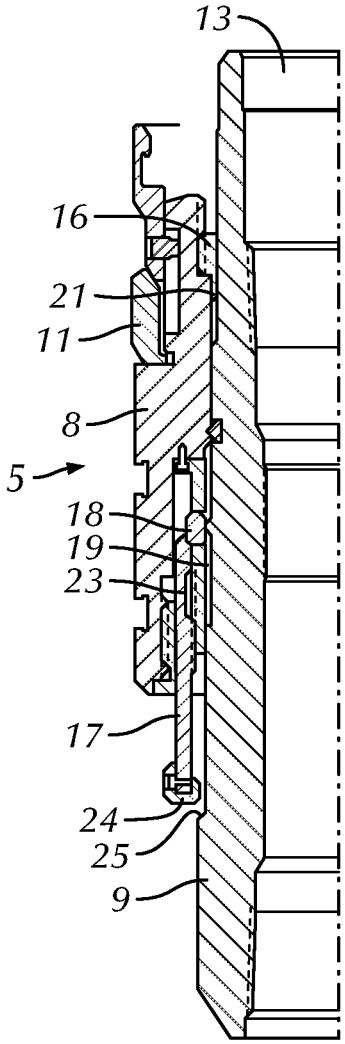
FIG. 3 is a cross-sectional view of a tubing hanger assembly in accordance with one or more embodiments of the present disclosure

Now referring to FIG. 3, in one more embodiments, the tubing hanger assembly 5 is illustrated in accordance the present disclosure is illustrated. As shown by FIG. 3, the tubing hanger assembly 5 includes the outer hanger body 8 and inner hanger body 9. The outer hanger body 8 may be directly connected to the tubing head (similar to FIG. 2) by landing on the load shoulder. In order to lock the outer hanger body 8 on the tubing head, a first latch ring 11 expands from the outer hanger body 8 into a groove of the tubing head, as will be further explained in FIGS. 6*a* and 6*b*. The groove may be machined, forged, cast, or formed by a manufacturing process known in the art. One skilled in the art will appreciate how the first latch ring 11 may be made from steel or another material having sufficient strength, tensile strength, flexural strength and other properties needed to perform the support described herein associated with tension loading. Furthermore, the first latch ring is attached to the outer hanger body 8. Once the outer hanger body 8 is locked, an upward movement of the outer hanger body 8 may be hindered by the first latch ring 11 and a downward movement of the outer hanger body 8 may be blocked by the shoulder of the tubing head. Additionally, the inner hanger body 9 is coupled to the at least one wellbore device 13. For example, the wellbore device 13 may be a tubing string, and thus allowing the inner hanger body 9 to engage tools further down in a wellbore (i.e., a packer or other down hole devices). As such, the inner hanger body 9 may move vertically up and down with respect to the outer hanger body 8. Additionally, the outer hanger body 8 may have a threaded nut 16 to limit the maximum upward movement of the inner hanger body 9. The threaded nut 16 has a shoulder stop 21 to engage and stop the inner hanger body 9.

Still referring to FIG. 3, a movable sleeve 17 or mandrel, having at least one mandrel groove 23, is disposed in between the inner hanger body 9 and the outer hanger body 8. The at least one mandrel groove 23 may be machined, forged, cast, or formed by a manufacturing process known in the art. The at least one mandrel groove 23 may include ledges, inclines, and shoulders on the movable sleeve 17 to facilitate collapsing and expanding of a fixed latch ring 18. Additionally, the movable sleeve 17 includes a bottom stop 24 to engage an inner shoulder 25 of the inner hanger body 9. As such, the inner hanger body 9 may move the movable sleeve 17 vertically when engaged with the bottom stop 24. It is further envisioned that the bottom stop 24 may be removably attached on or forged to the movable sleeve 17. The at least one mandrel groove 23 is used to expand and collapse the fixed latch ring 18 disposed between the inner hanger body 9 and the movable sleeve 17. Furthermore, the inner hanger body 9 may have at least one inner hanger groove 19 to aid in expanding and collapsing the fixed latch ring 18. The at least one inner hanger groove 19 may be machined, forged, cast, or formed by a manufacturing process known in the art. The at least one inner hanger groove 19 may include ledges, inclines, and shoulders on the inner hanger body 9 to facilitate collapsing and expanding of the fixed latch ring 18. Additionally, the fixed latch ring 18 may be fixed vertically and be used as a stop to support the inner hanger body 9 and the tension load from the inner hanger body 9. One skilled in the art will appreciate how the second latch ring 15 may be made from steel or another material having sufficient strength, tensile strength, flexural strength and other properties needed to perform the support described herein associated with tension loading.

Figure 4C:
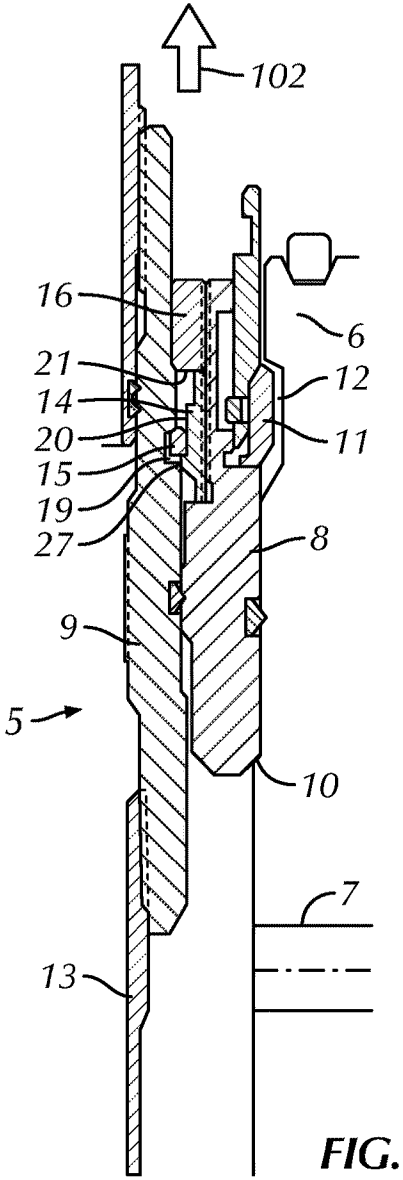
FIGS. 4*a*-4*f* are cross-sectional views of the tubing hanger assembly in accordance with FIG. 2 of the present disclosure.
Figure 4B:
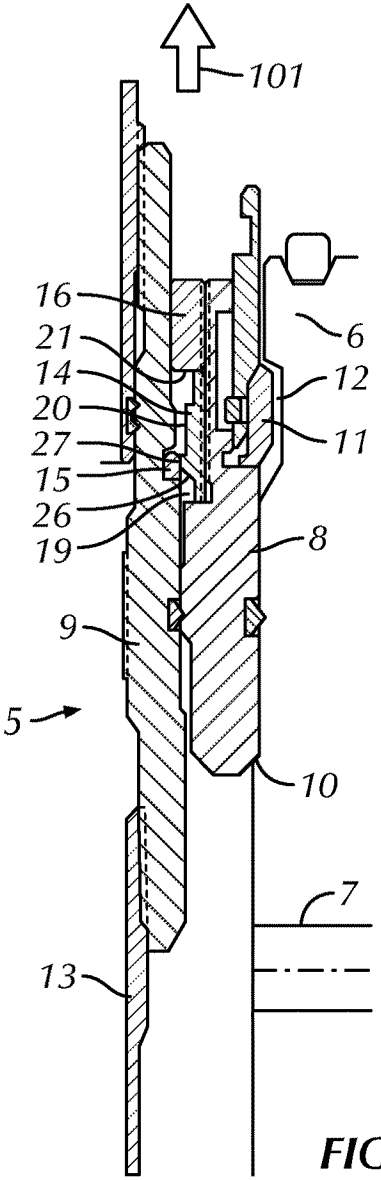
Figure 4A:
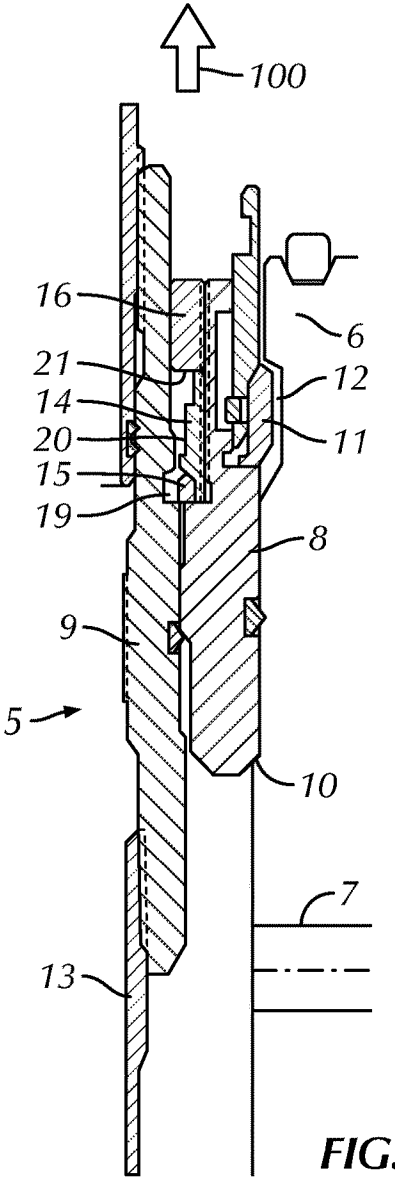
Figure 4F:
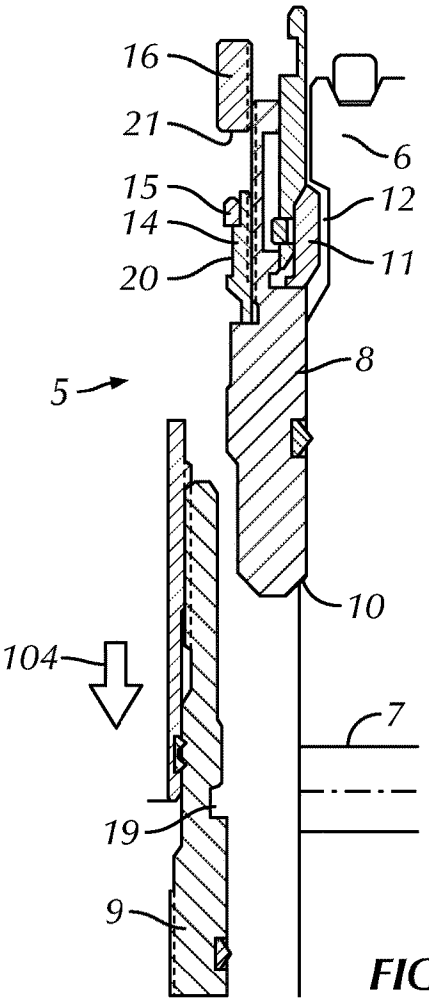
Figure 4E:
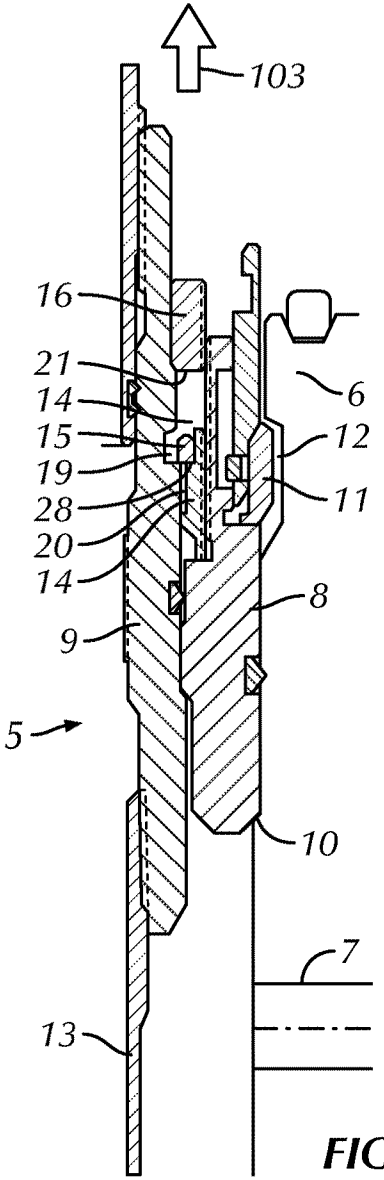

Now referring to FIG. 4*a*-4*f*, cross-sectional views of the tubing hanger assembly 5 are illustrated in accordance with FIG. 2 of the present disclosure. As shown in FIG. 2, the first latch ring 11 is expanded in the groove 12 of the tubing head 6, and thus, locking the tubing hanger assembly 5 to make the outer hanger body 8 have restricted movement. With the outer hanger body 8 restricted, as shown by FIG. 4*a*, the inner hanger body 9 may move vertically downward with respect to the outer hanger body 8, allowing for the wellbore device 13 to engage with a structure below the tubing hanger assembly 5. For instance, in some embodiments, the wellbore device 13 may comprise a tubing string and the structure below the tubing hanger assembly 5 may comprise a packer, and the downward movement of the inner hanger body 9 with respect to the outer hanger body 8 may allow the tubing string to move downward toward and engage with the packer. Once engaged, the inner hanger body 9 may move vertically up (see arrow 100) with respect to the outer hanger body 8 (i.e., applying tension to the tubing string). The at least one inner hanger groove 19 engages the second latch ring 15. Now the inner hanger body 9 may move further up, as shown by arrow 101 in FIG. 4*b*, to collapse the second latch ring 19 within the at least one inner hanger groove 19.

In some embodiments, to collapse the second latch ring 15, the second latch ring is pushed upward by the inner hanger body 9 to move along an inclined path 26 of the fixed sleeve 14. Additionally, the inclined path 26 may have a slope suitable to aid in moving the second latch ring 15. For example, the slope may have a low inclination to move the second latch ring 15 at a slow rate or a high inclination to move the second latch ring 15 at a high rate. One skilled in the art will appreciate how the slope of the inclined path 26 may be designed to control the speed at which the second latch ring 15 moves to allow for a more stable movement of the inner hanger body 9. Then, as the inner hanger body 9 moves in the direction of arrow 101, a ledge 27 of the fixed sleeve aids in collapsing the second latch ring 15 into the at least one inner hanger groove 19. Now referring to FIG. 4*d*, the inner hanger body 9 moves further up (see arrow 102), and thus, allowing second latch ring 15 to expand on top of the ledge 27 created by the plurality of grooves 20 of the fixed sleeve 14.

Figure 4D:
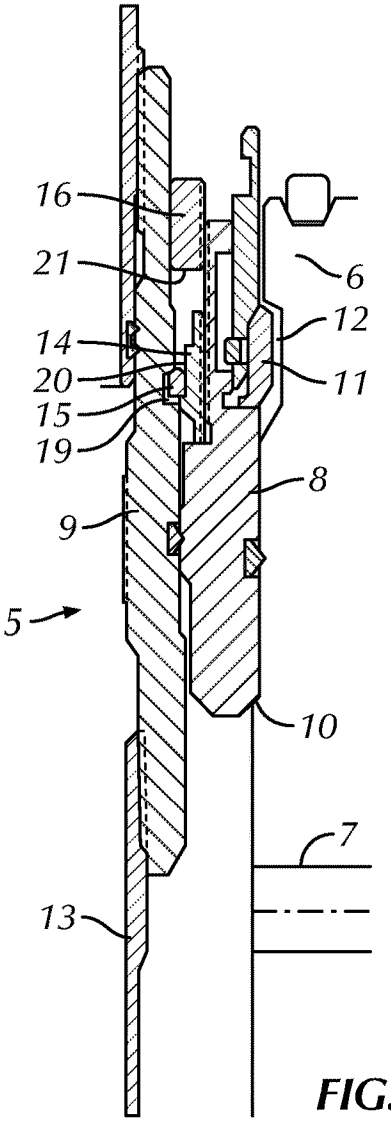

Still referring to FIG. 4*c*, in one or more embodiments, the inner hanger body 9 is now engaged with the shoulder stop 21 of the threaded nut 16, therefore, the inner body 9 may no longer move further up. Additionally, the second latch ring 15 acts as a tension load support in the position above the ledge 27. With the second latch ring 15 sitting on the ledge 27, the inner hanger body 9, having pulled the wellbore device 13 in tension, may now be at rest while still keeping the wellbore device 13 in tension. In some embodiments, when the second latch ring 15 is expanded to sit on the ledge 27, the second latch ring 15 restricts the downward movement of the inner hanger body 9 to keep the wellbore device 13 in tension. One skilled in the art will appreciate how the inner hanger body 9 may no longer be pulled to keep the wellbore device 13 in tension since the second latch ring 15 is now supporting the tension load. After any operations are performed, where the second latch ring 15 is needed to be the tension load support, the thread nut 16 may be unthreaded from the outer hanger body 8, as shown by FIG. 4*d*. One skilled in the art will appreciate how the threaded nut 16 may be completely unthreaded or partially unthreaded. With the threaded nut 16 unthreaded, the tension is released and the inner hanger body 9 may move further up, as shown by arrow 103 of FIG. 4*e*. Further shown by FIG. 4*e*, the inner hanger body 9 has now moved the second latch ring 15 further up to a second ledge 28 of the fixed sleeve 14. As such, the second latch ring 15 expands from the at least one groove 19 to sit on the second ledge 28 and no longer supports the inner hanger body 9. In some embodiments, the inner hanger body 9 is now free to travel downward, (see arrow 104 in FIG. 4*f*) for installation or operation of a down hole device. Furthermore, the first latch ring 11 may be disengaged, as will be further explained in FIGS. 7*a* and 7*b*, and the tubing hanger assembly 5 may be retrieved for repair, replacement, or different operational needs. One skilled in the art will appreciate how the first latch ring 11 and the second latch ring 15 may be re-used. Furthermore, while FIGS. 4*a*-4*f* show two latch rings, it is further envisioned that the tubing hanger assembly 5 may include three or more latch rings.

Figure 5C:
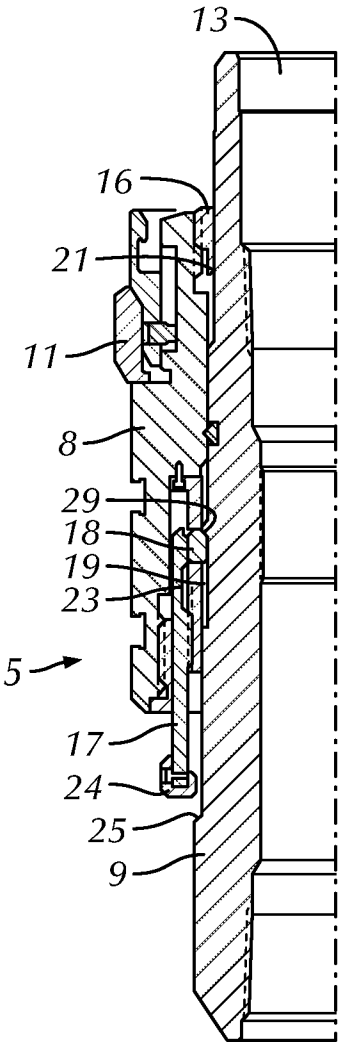
FIGS. 5*a*-5*e* are cross-sectional views of the tubing hanger assembly in accordance with FIG. 3 of the present disclosure.
Figure 5B:
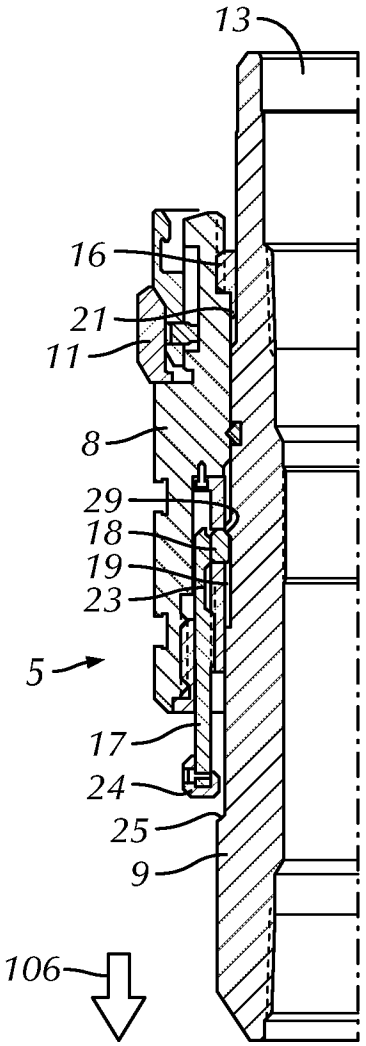
Figure 5A:
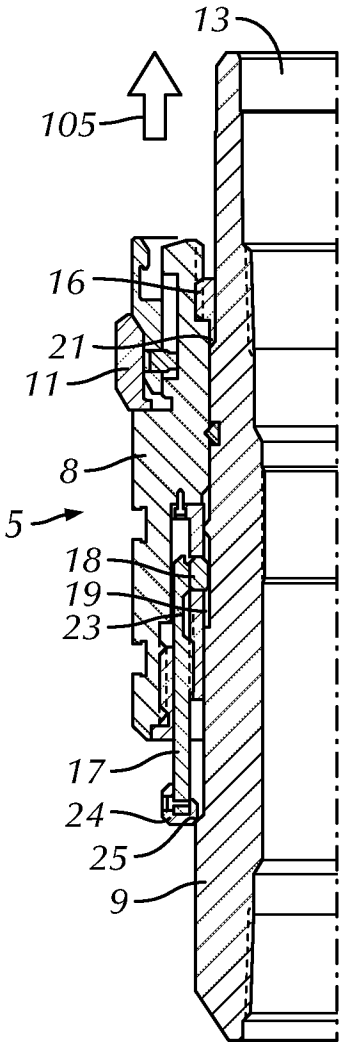
Figure 5D:
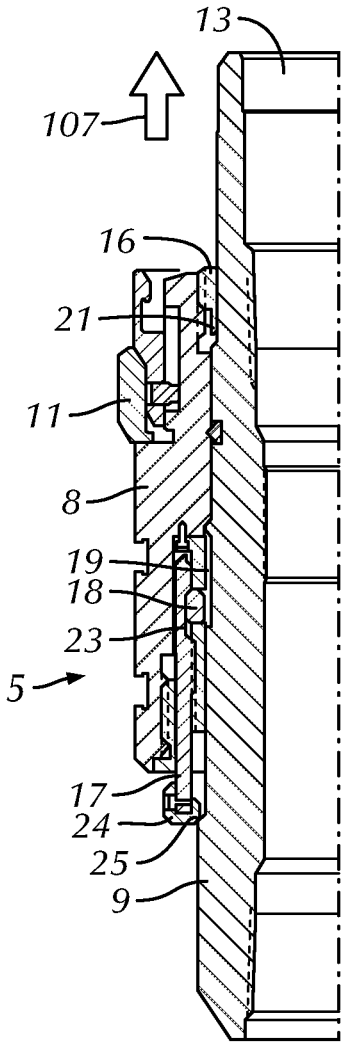
Figure 5E:
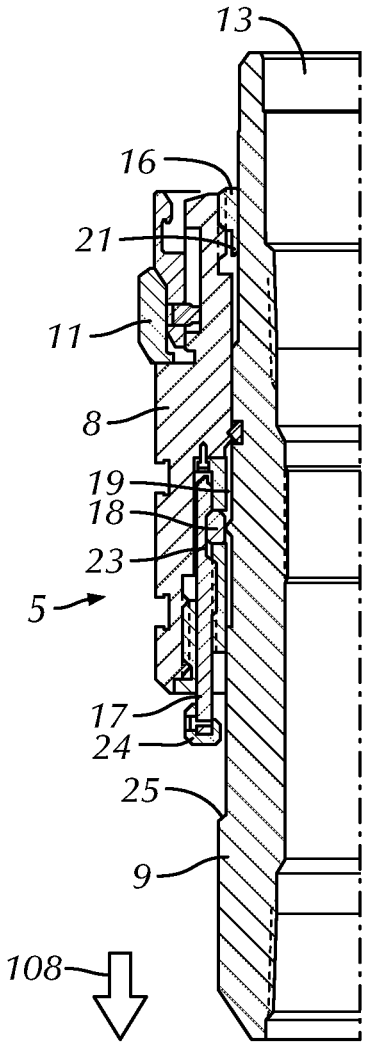

Now referring to FIG. 5*a*-5*e*, cross-sectional views of the tubing hanger assembly 5 are illustrated in accordance with FIG. 3 of the present disclosure. As shown in FIG. 3, the first latch ring 11 is expanded in the groove of the tubing head (not shown), and thus, locking the tubing hanger assembly 5 to make the outer hanger body 8 have restricted movement. With the outer hanger body 8 restricted, as shown by FIG. 5*a*, the inner hanger body 9 may move vertically downward with respect to the outer hanger body 8, allowing for the wellbore device 13 to engage with a structure below the tubing hanger assembly 5. For instance, in certain embodiments, the wellbore device 13 may comprise a tubing string and the structure below the tubing hanger assembly 5 may comprise a packer, and the downward movement of the inner hanger body 9 with respect to the outer hanger body 8 may allow the tubing string to move downward toward and engage with the packer. Once engaged, the inner hanger body 9 may move vertically up (see arrow 105) with respect to the outer hanger body 8 (i.e., applying tension to the tubing string). The inner shoulder 25 of the inner hanger body 9 engages the bottom stop 24 of the movable sleeve 17 and moves the movable sleeve 17 upwards. Additionally, movable sleeve 17 collapses the fixed latch ring 18 into the at least one groove 19 of the inner hanger body 9. Still referring to FIG. 5*a*, the inner hanger body 9 is now engaged with the shoulder stop 21 of the threaded nut 16, and therefore, the inner body 9 may no longer move further up. Now that the fixed latch ring 18 is within the at least one groove 19, the inner hanger body 9 moves down (see arrow 106 in FIG. 5*b*) to have an inner ledge 29 of the inner hanger body 9 engage with the fixed latch ring 18 and the movable sleeve 17 may aid in keeping the fixed latch ring 18 in the aforementioned position. As shown by FIGS. 5*b* and 5*c*, the fixed latch ring 18 is now the tension load support for the inner hanger body 9. With the fixed latch ring 18 collapsed in the at least one groove 19 and the inner ledge 29 sitting on the fixed latch 18, the inner hanger body 9, having pulled the wellbore device 13 in tension, may now be at rest while still keeping the wellbore device 13 in tension. In some embodiments, when the fixed latch ring 18 is collapsed in the at least one groove 19 and the inner ledge 29 sitting on fixed latch ring 18, the fixed latch ring 18 restricts the downward movement of the inner hanger body 9 to keep the wellbore device 13 in tension. One skilled in the art will appreciate how the inner hanger body 9 may no longer be pulled to keep the wellbore device 13 in tension since the fixed latch ring 18 is now supporting the tension load.

Now referring to FIG. 5*c*, after any operations are performed, where the fixed latch ring 18 is needed to be the tension load support, the thread nut 16 may be unthreaded from the outer hanger body 8, as seen by FIG. 5*c*. One skilled in the art will appreciate how the thread nut 16 may be completely unthreaded or partially unthreaded. With the thread nut 16 unthreaded, the tension is released and the inner hanger body 9 may move further up, as shown by arrow 107 of FIG. 5*d*. Further shown by FIG. 5*d*, the inner hanger body 9 has now re-engaged the bottom stop 24 with the inner shoulder 25 to move the movable sleeve 17 further up and allow the fixed latch 18 to expand in the at least one mandrel groove 23. As such, the fixed latch ring 18 no longer supports the inner hanger body 9. In some embodiments, the inner hanger body 9 is now free to travel downward, (see arrow 108 in FIG. 5*e*) for installation or operation of a down hole device. Furthermore, the first latch ring 11 may be disengaged, as will be further explained in FIGS. 7*a* and 7*b*, and the tubing hanger assembly 5 may be retrieved for repair, replacement, or different operational needs. One skilled in the art will appreciate how the first latch ring 11 and the fixed latch ring 18 may be re-used. Furthermore, while FIGS. 5*a*-5*e* show two latch rings, it is further envisioned that the tubing hanger assembly 5 may three or more latch rings.

Figure 6A:
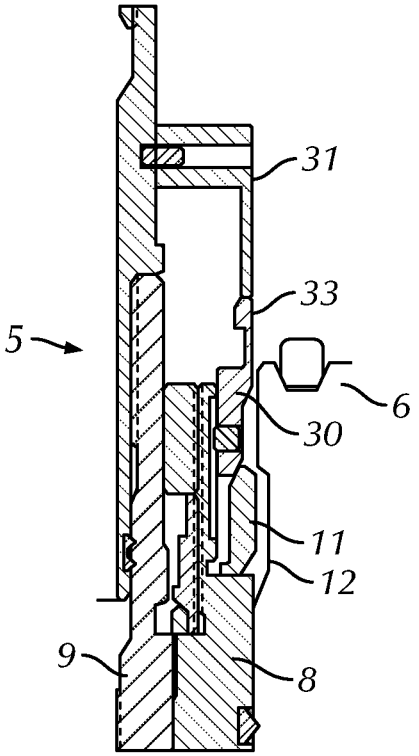
FIGS. 6*a*-6*b* are cross-sectional views of installing the tubing hanger assembly in accordance with one or more embodiments of the present disclosure.
Figure 6B:
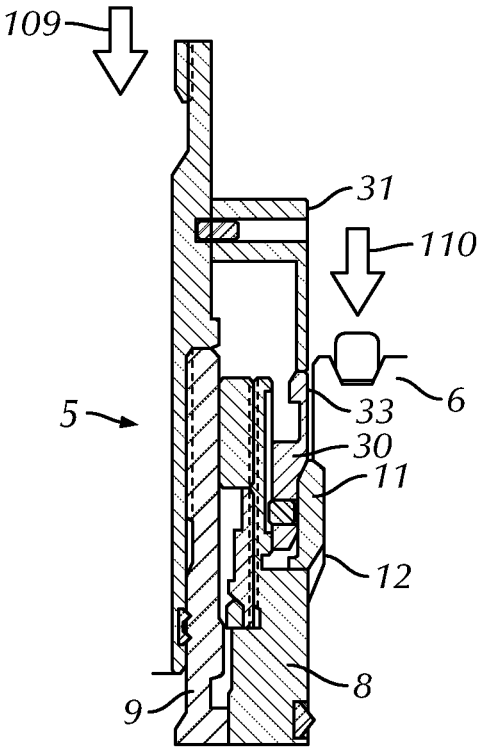

Now referring to FIGS. 6*a*-6*b*, cross-sectional views of installing the tubing hanger assembly 5 in accordance with one or more embodiments of the present disclosure are illustrated. As described above, in order to lock the outer hanger body 8 on the tubing head 6, the first latch ring 11 expands from the outer hanger body 8 into the groove 12 of the tubing head 6. To accomplish expanding the first latch ring 11, once the outer hanger body 8 is landed on the tubing head 6, a lock mandrel 30 and an installation tool sleeve 31 are used in conjunction with the movement of the inner hanger body 9 to expand the first latch ring 11.

As shown in FIG. 6*a*, the lock mandrel 30 is in an up position above the first latch ring 11, which is collapsed against the outer hanger body 8. The lock mandrel 30 is designed to have a shape which is specific to engaging the first latch ring 11. Additionally, the installation tool sleeve 31 is above the lock mandrel 30 and may engage with a top portion 33 of the lock mandrel 30. One skilled in the art will appreciate how the installation tool sleeve 31 may be directly or indirectly connected with the inner hanger body 9. Now referring to FIG. 6*b*, in some embodiments, the inner hanger body 9 is moving downwards (see arrow 109), which in turn moves the installation tool sleeve 31 downward (see arrow 110). It is further envisioned that the downward movement of the installation tool sleeve 31 is not limited to only moving down when the inner hanger body 9 moved, and other devices may be used to move the installation tool sleeve 31. With the installation tool sleeve 31 moving down (see arrow 110), the installation tool sleeve 31 is applying a force (not shown) to the top portion 33 of the lock mandrel 30. With the force acting on the top portion 33 of the lock mandrel 30, the lock mandrel 30 moves to a down position and expands the first latch ring 11 into the groove 12 of the tubing head 6 (i.e., restricting the upward movement of outer hanger body 9). As described above, once the outer hanger body's 8 movement is restricted or in position, the inner hanger body 9 may perform the needed operations, Now referring to FIGS. 7*a*-7*b*, cross-sectional views of retrieving the tubing hanger assembly 5 in accordance with one or more embodiments of the present disclosure are illustrated. As described above, the first latch ring 11 may be disengaged and the tubing hanger assembly 5 may be retrieved for repair, replacement, or different operational needs. To accomplish collapsing of the first latch ring 11, to retrieve the tubing hanger assembly 5, a retrieval tool spear 32 with a spear tip 34 and an installation tool sleeve 31 is used in conjunction with the movement of the inner hanger body 9 to collapse the first latch ring 11.

Figure 7A:
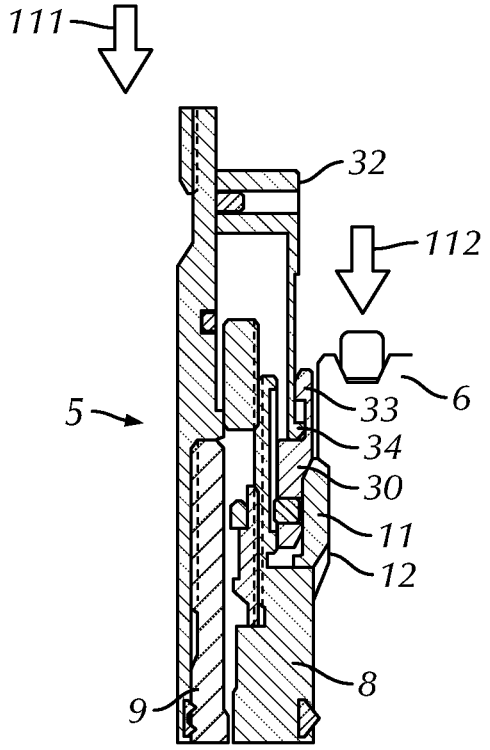
FIGS. 7*a*-7*b* are cross-sectional views of retrieving the tubing hanger assembly in accordance with one or more embodiments of the present disclosure.
Figure 7B:
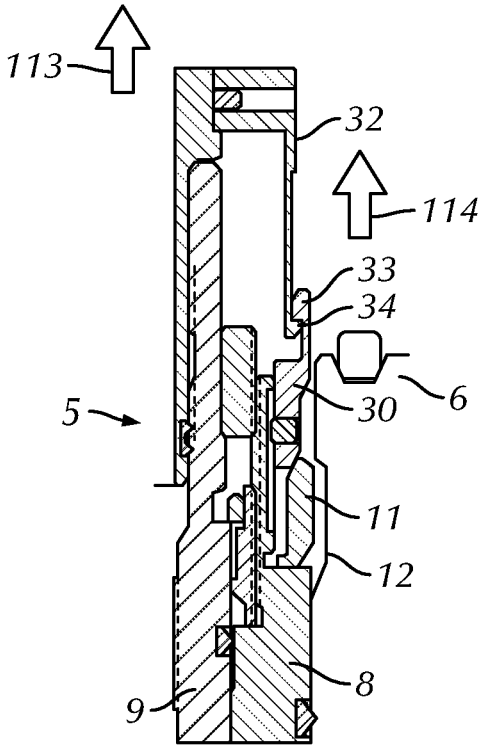

As shown in FIG. 7*a*, the lock mandrel 30 is in the down position to expand the first latch ring 11 into the groove 12 of the tubing head, thus locking the outer hanger body 8 in position. When the outer hanger body is needed to be unlocked, the retrieval tool spear 32 is used. Additionally, the inner hanger body 9 moves downward (see arrow 111) to move the retrieval tool spear 32 downward (see arrow 112)

and have the spear tip 34 move past the top portion 33 of the lock mandrel 30. One skilled in the art will appreciate how the retrieval tool spear 32 may be directly or indirectly connected with the inner hanger body 9. Now referring to FIG. 7*b*, in some embodiments, the inner hanger body 9 is moving upwards (see arrow 113), which in turn moves the retrieval tool spear 32 upward (see arrow 114). It is further envisioned that the upward movement of the retrieval tool spear 32 is not limited to only moving up when the inner hanger body 9 moved, and other devices may be used to move the retrieval tool spear 32. With the retrieval tool spear 32 moved to an up position, the spear tip 34 may engage with the top portion of the top portion 33 of the lock mandrel 30. The spear tip 34 translates an upward force to the lock mandrel 30 and moves the lock mandrel 30 to the up position above the first latch ring 11. Once the lock mandrel 30 is in the up position, the first latch ring 11 collapses back against the outer hanger body 8 (i.e., unrestricting the movement of the outer hanger body 9). Now that the first latch ring 11 is collapsed, the tubing hanger assembly 5 may be retrieved for repair, replacement, or different operational needs. It is further envisioned that the installation tool sleeve 31 and the retrieval tool spear 32 may be integrated to form one device for expanding and collapsing the first latch ring 11; additionally, the lock mandrel 30 may be integrated to form one installation and retrieval device for the tubing hanger assembly 5.

Tension latch tubing hangers, according to embodiments herein, are apparatuses that include multiple latch rings within a tubing head, may include no lock-down screws installed from outside the tubing head, within the multiple components that are arranged in a certain layout and contained within a tension tubing hanger. The elimination of lock-down screws installed from outside the tubing head significantly improves the operational safety during drilling, completions, production, work-over operations, and reduces the number of leak paths to a wellbore environment. The latch ring included in the tubing hanger assembly may be used to directly or indirectly engage an outer hanger body and inner hanger body of the tension tubing hanger. In addition, one or more sleeves may be used to collapse and expand the multiple latch rings. Furthermore, other instruments and devices, including without limitation, sensors and various valves may be incorporated within the tension tubing hanger.

Conventional retention of the tension tubing hanger in the oil and gas industry is typically retained by lock-down screws installed from outside the tubing head. Conventional methods may include an extensive layout and arrangement to ensure the lock down screws may be properly installed from outside of the tubing head. In some instances, the tubing head is manufactured to include slots used to hold the lock-down screws and an apparatus to extend the lock-down screws into tubing hanger. Such tubing head may be more expensive to manufacture because of the extra machining needed to account for lock-down screws. Further, the use of lock-down screws may increase the potential the number of leak paths to the wellbore environment. For example, in order to retain the tension tubing hanger by conventional methods, lock-down screws are engaged from outside the tubing head and through the tubing head to the tension tubing hanger. By travel through the tubing hanger, additional openings in the tubing hanger are required to retain the tension tubing hanger with lock-down screws. This additional need for openings, increases the number of leak paths, adds to manufacturing and installation costs, and decreases the operational safety.

The tension tubing hanger is often used for assisting in setting the packer and locking the tubing string in tension. Examples of the tension tubing hanger may be used for drilling, completion applications, including natural flow, gas lift, and artificial lift systems in onshore and offshore wells and to continue producing for conventional and unconventional wells. Examples of the tension tubing include a two-piece tensioning mechanism for nominal wellhead sizes range from 7 1/16 inches to 11 inches and above, with tubing sizes ranging from 2 3/8 inches and above. Achieving a successful retention of the tension tubing hanger in the tubing head is an important part of a well operation. Additional challenges further exist in a subsea environment for safely retaining the tension tubing hanger while both minimizing costs and providing flexibility for future changes to the overall layout of a field or well.

Accordingly, one or more embodiments in the present disclosure may be used to overcome such challenges as well as provide additional advantages over conventional methods of retention, as will be apparent to one of ordinary skill. In one or more embodiments, a tension latch tubing hanger apparatus may be safer, faster, and lower in cost as compared with conventional methods retaining due, in part, to multiple latch rings within the tubing head for retaining the tension tubing hanger in the tubing head. Additionally, the tension latch tubing hanger may comprise components that are forged and/or machined thus requiring no additional manufacturing to the tubing head, relaxing control tolerances and improving manufacture (i.e. reduced cost and reduced time to manufacture). Furthermore, the tension latch tubing hanger has no need for lock-down screws to reduce the number of openings in the tubing head and operations to the subsea equipment the tubing head is attached to. Overall the tension latch tubing hanger may minimize product engineering, risk associated with lock-down screws, reduction of assembly time, hardware cost reduction, and weight and envelope reduction. Further, the tension latch tubing hangers disclosed herein include structures that facilitate the axial movement, locking, and release of the inner hanger with respect to the outer hanger.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A tubing hanger assembly, comprising:

an outer hanger body configured to land on a load shoulder of a tubing head;

an inner hanger body having at least one inner hanger groove and configured to move vertically up and down with respect to the outer hanger body and engage at least one wellbore device;

a first latch ring configured to expand in a groove of the tubing head to lock the outer hanger body in position;

a sleeve with a plurality of grooves disposed between the outer hanger body and the inner hanger body of the tubing hanger assembly; and a second latch ring disposed between the sleeve and the inner hanger body, wherein the second latch ring is configured to expand into or collapse out of the at least one inner hanger groove and the plurality of grooves, and the second latch ring is a tension loading support for the inner hanger body, wherein the sleeve is movable, and the movable sleeve comprises a bottom stop to engage the inner hanger body.

2. The tubing hanger assembly of claim 1, wherein the second latch ring is fixed vertically with respect to the movable sleeve.

3. The tubing hanger assembly of claim 1, further comprising a threaded nut connected to the outer hanger body.

4. The tubing hanger assembly of claim 3, wherein the threaded nut comprises a stop shoulder configured to limit the vertical movement of the inner hanger body.

5. The tubing hanger assembly of claim 1, wherein the tubing head is ported.

6. A method, comprising:

landing an outer hanger body of a tubing hanger assembly on a load shoulder of a tubing head;

locking the outer hanger body of the tubing hanger assembly in position with a first latch ring expanding into a groove of the tubing head;

moving down an inner hanger body of the tubing hanger assembly to engage at least one wellbore device and moving the inner hanger body up;

collapsing a second latch ring into at least one inner hanger groove;

moving up the inner hanger body to expand the second latch ring into one of a plurality of grooves in a sleeve to provide a tension load support for the inner hanger body and the at least one wellbore device; and expanding the second latch ring in a second of the plurality of grooves by further moving up the inner hanger body, and moving the inner hanger body down and disengaging the at least one wellbore device.

7. The method of claim 6, further comprising moving the sleeve along with the inner hanger body.

8. The method of claim 6, further comprising moving the second latch ring along with the inner hanger body.

9. The method of claim 6, further comprising threading a nut to the outer hanger body to stop the inner hanger body and collapse the second latch ring.

10. The method of claim 9, further comprising unthreading the nut from the outer hanger body to further move the inner hanger body and expand the second latch ring.

11. The method of claim 6, further comprising engaging a down hole packer with the at least one wellbore device.

12. The method of claim 6, further comprising disposing the tubing head on a wellhead.

13. The method of claim 6, further comprising collapsing the first latch ring to retrieve the tubing hanger assembly.

14. A system, comprising:

a wellhead;

a tubing head with a load shoulder;

a tubing hanger assembly, comprising:

an outer hanger body configured to land on the load shoulder of the tubing head;

an inner hanger body having at least one inner hanger groove and configured to move vertically up and down with respect to the outer hanger body and engage at least one wellbore device;

a first latch ring configured to expand in a groove of the tubing head to lock the outer hanger body in position;

a sleeve with a plurality of grooves disposed between the outer hanger body and the inner hanger body of the tubing hanger assembly; and a second latch ring disposed between the sleeve and the inner hanger body, wherein the second latch ring is configured to expand into or collapse out of the at least one inner hanger groove and the plurality of grooves, and the second latch ring is a tension loading support for the inner hanger body, wherein the sleeve is movable, and the wherein the movable sleeve comprises a bottom stop to engage the inner hanger body.

15. The system of claim 14, wherein the second latch ring is fixed vertically with respect to the movable sleeve.

16. The system of claim 14, further comprising a threaded nut connected to the outer hanger body.

17. The system of claim 16, wherein the threaded nut comprises a stop shoulder configured to limit the vertical movement of the inner hanger body.

18. The system of claim 14, wherein the at least one wellbore device is a tubing string to engage a down hole packer.

19. The system of claim 14, wherein the tubing head is ported.

20. The system of claim 14, wherein the tubing head is disposed on the wellhead.

* * * * *